United States Patent [19]

Miyamoto et al.

[11] Patent Number: 4,890,138

[45] Date of Patent: Dec. 26, 1989

[54] IMAGE FORMING APPARATUS HAVING A PLURALITY OF DEVELOPING DEVICES

[75] Inventors: Hirohisa Miyamoto; Naoyoshi Kinoshita, both of Osaka, Japan

[73] Assignee: Minolta Camera Kabushiki Kaisha, Osaka, Japan

[21] Appl. No.: 326,499

[22] Filed: Mar. 20, 1989

Related U.S. Application Data

[63] Continuation of Ser. No. 141,858, Jan. 22, 1988, abandoned.

[30] Foreign Application Priority Data

Jan. 12, 1987 [JP] Japan ..... 62-4394

[51] Int. Cl.[4] ..... G03G 15/08

[52] U.S. Cl. ..... 355/246; 355/245; 355/261

[58] Field of Search ..... 355/246, 245, 261, 219

[56] References Cited

U.S. PATENT DOCUMENTS

| | | | |
|---|---|---|---|
| 4,695,723 | 9/1987 | Minor | 355/14 CH X |
| 4,731,313 | 3/1988 | Haneda | 355/4 X |
| 4,766,460 | 8/1988 | Yamamoto et al. | 355/4 |
| 4,772,918 | 9/1988 | Karasawa et al. | 355/14 CH X |
| 4,778,740 | 10/1988 | Takashima et al. | 355/4 X |
| 4,791,452 | 12/1988 | Kasai et al. | 355/246 X |
| 4,801,980 | 1/1989 | Arai et al. | 355/246 X |

FOREIGN PATENT DOCUMENTS

| | | |
|---|---|---|
| 55-83070 | 6/1980 | Japan . |
| 56-52760 | 12/1981 | Japan . |
| 61-198259 | 2/1986 | Japan . |
| 62-75465 | 7/1987 | Japan . |

*Primary Examiner*—A. C. Prescott

*Attorney, Agent, or Firm*—Wenderoth, Lind & Ponack

[57] ABSTRACT

The apparatus includes a photosensitive drum, a charger for charging the drum, a plurality of developing devices, selecting switch for selecting one of the developing devices to be used and controller for controlling the output of the charger so as to elevate the surface potential of the drum by a predetermined potential corresponding to the selection by the selecting switch, said predetermined potential being equal to a decay potential occurring while the surface of the drum rotates from the position opposed to the charger to the portion opposed to the selected developing device.

8 Claims, 6 Drawing Sheets

IMAGE FORMING APPARATUS HAVING A PLURALITY OF DEVELOPING DEVICES

This application is a continuation of now abandoned patent application Ser. No. 141,858, filed Jan. 11, 1988.

BACKGROUND OF THE INVENTION

The present invention relates to a copying machine or printer incorporating a plurality of developing devices.

To meet the requirement for multi-color copying, copying machines have been proposed in recent years which have a plurality of developing devices provided around a photosensitive drum and adjacent thereto. The copying machine develops an electrostatic latent image in one of various colors with one of the developing devices selectively driven.

However, the above copying machine has the problem that the surface potential of the photosensitive member differs at the positions opposed to the developing devices. This is because the different developing devices require different periods of time to rotate from charging position to developing position.

The difference in the surface potential due to the difference in the developing position gives rise to a difference in the image density of copy images developed by the developing devices even if the same original is copied. The above phenomenon appears attributable to the difference between the developing positions in the developing voltage (which is the difference between the developing potential applied to the developing device and the surface potential of the photosensitive member).

SUMMARY OF THE INVENTION

The main object of the invention is to overcome the foregoing problem of the prior-art apparatus and to provide an image forming apparatus having a plurality of developing devices and adapted to produce copy images of the same density at all times from the same original even when any one of the devices is used.

To fulfill the object, the invention provides an image forming apparatus which comprises:

a rotatable photosensitive member having a photosensitive layer over its surface, a charger for charging the photosensitive member, a first developing device opposed to the photosensitive member for developing an electrostatic latent image formed on the member, a second developing device positioned downstream from the first developing device with respect to the direction of rotation of the photosensitive member for developing an electrostatic latent image formed on the member, means for selecting one of the first and second developing devices to be used, and means for controlling the output of the charger so as to elevate the surface potential of the photosensitive member by a predetermined potential when the second developing device is selected by the selecting means, the predetermined potential being equal to a decay potential occurring while the surface of the photosensitive member rotates from the position opposed to the first developing device to the position opposed to the second developing device.

To fulfill the above object, the invention further provides an image forming apparatus which comprises:

a rotatable photosensitive member having a photosensitive layer over its surface, a charger for charging the photosensitive member, a first developing device having a rotatable developing roller for developing an electrostatic latent image formed on the member, a second developing device positioned downstream from the first developing device with respect to the direction of rotation of the photosensitive member and having a rotatable developing roller for developing an electrostatic latent image formed on the photosensitive member, first application means for applying a bias voltage to the developing roller of the first developing device, and second application means for applying to the developing roller of the second developing device a bias voltage lower than the output from the first application means by a predetermined voltage, the predetermined voltage being equal to a decay potential occurring while the surface of the photosensitive member rotates from the position opposed to the first developing device to the position opposed to the second developing device.

To achieve the foregoing object, the invention further provides an image forming apparatus which comprises:

a rotatable photosensitive member having a photosensitive layer over its surface, a charger for charging the photosensitive member, means having a light source for locally erasing the charge from the photosensitive member by the light from the light source to thereby form an electrostatic latent image on the member, a first developing device opposed to the photosensitive member for developing the electrostatic latent image formed on the member, a second developing device positioned downstream from the first developing device with respect to the direction of rotation of the photosensitive member for developing the electrostatic latent image formed on the member means for selecting one of the first and second developing devices to be used, and control means for increasing the amount of light from the light source of the image forming means by a predetermined amount when the first developing device is selected by the selecting means, the predetermined amount being an amount required for lowering the surface potential of the photosensitive member by the same amount as potential decay occuring while the surface of the member rotates from the position opposed to the first developing device to the position opposed to the second developing device.

The above and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE INVENTION

Embodiments of the invention will be described below with reference to the drawings.

Figure 1:
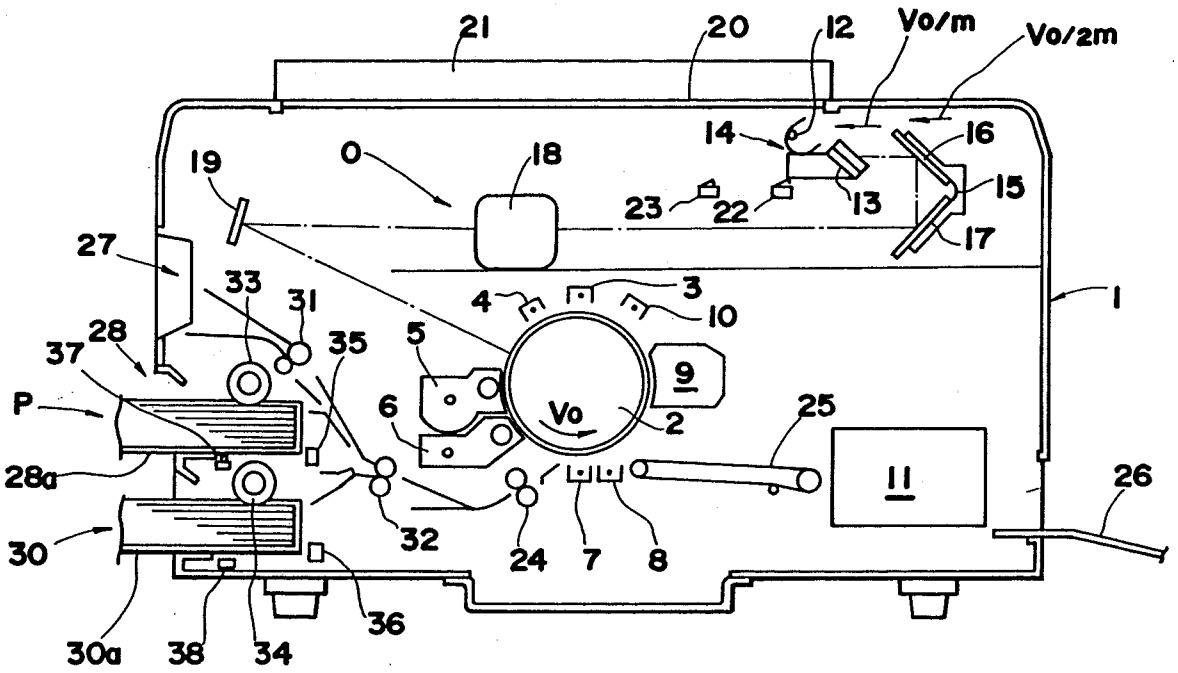
FIG. 1 is a sectional view schematically showing the construction of a copying machine to which the invention is applied.

As seen in FIG. 1, a copying machine 1 has approximately in the center of its interior a photosensitive drum 2 supported by a shaft and drivingly rotatable counterclockwise by an unillustrated main motor. Arranged around the drum 2 in the direction of rotation of the drum are a sensitizing charger 3, inter-image eraser 4, first developing device 5, second developing device 6, transfer charger 7, separating charger 8, cleaner 9 and main eraser 10. An optical system 0 is disposed above the drum 2 and the components around the drum. A paper feed system P is provided at the left side of the drum-including assembly, and a fixing unit 11 at the right side thereof. At least three developing devices may be provided. The developers contained in the developing devices are chargeable to a definite amount per unit mass.

The optical system O comprises a scanning unit 14 of the slit exposure type including a light source 12 and a first movable mirror 13, a second movable mirror 16 and a third movable mirror 17 which are held on a common holder 15, a lens 18 and a fixed mirror 19.

Figure 2:
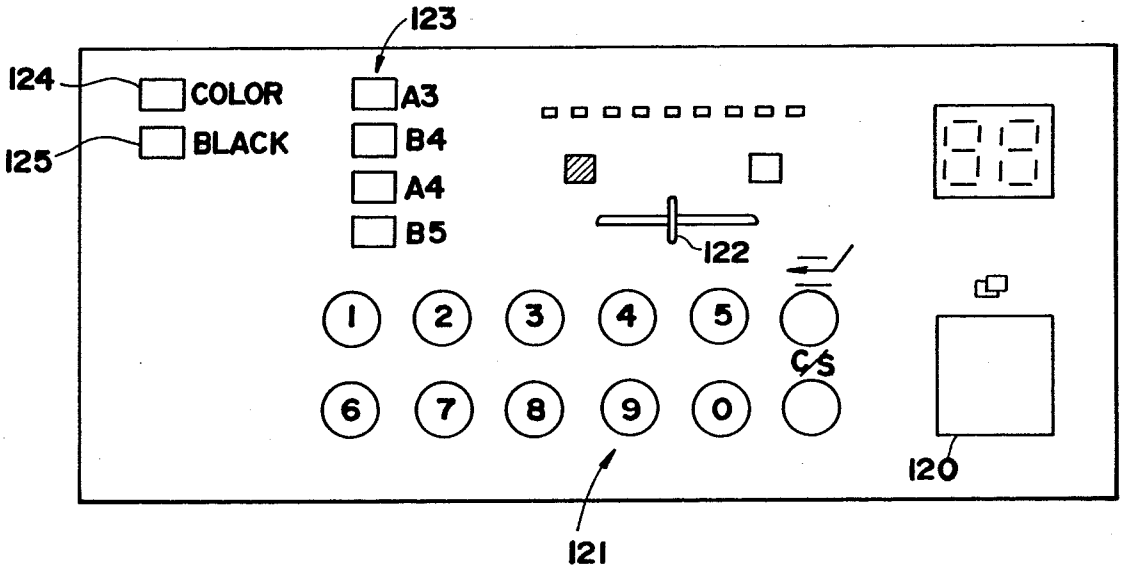
FIG. 2 is a plan view showing the operation panel of the copying machine of FIG. 1.

FIG. 2 shows an operation panel mounted on the top side of the copying machine 1. The panel is provided with a print switch 120 for starting a copying operation, a group of number entry keys 121 for specifying the number of copies to be made, a knob 122 for adjusting the amount of exposure, a group of keys 123 for selecting copy paper sizes, a selection key 124 for specifying color copying and a selection key 125 for specifying usual copying. The signals from the keys are fed to a microcomputer (hereinafter referred to as "CPU") 200, which in turn controls the operation of the developing devices, sensitizing charger, etc. In the present embodiment, the first developing device 5 is selected by the selection key 124, and the second developing unit 6 by the selection key 125.

The print switch 120 of the machine 1, when depressed, initiates the drum 2 into rotation. First, an electrostatic latent image corresponding to the image of an original is formed on the drum 2 in the following manner. The eraser 4 is adapted to remove charge from an inter-image area on the drum 2 which area corresponds to the area preceding the front end, with respect to the scanning direction, of the original (not shown) through the area beyond the original rear end with respect to the scanning direction. The original is set in position between a document support glass table 20 and a document holder 21. The surface of the drum 2 is positively charged by the sensitizing charger 3 over an area corresponding to the original. With the light source 12 turned on, the original is scanned by the scanning unit 14 while the unit is being moved leftward in FIG. 1 by an unillustrated scanning motor.

The scanning unit 14 is moved at a velocity V which is equal to Vo/m wherein Vo is the peripheral velocity of the drum 2, and m is the magnification. During scanning, the second movable mirror 16 and the third movable mirrors 17 are moved leftward in the drawing at a velocity of Vo/2m. To operate the paper feed system P as timed with the scanning unit 14, the unit 14 is adapted to press a timing switch 23 when the unit 14 has traveled a predetermined distance after starting the scanning movement, for the switch 23 to give the CPU 200 a timing signal for operating the timing roller 24 to be described below.

A negatively charged toner is deposited on the surface of the drum 2 from the first developing device 5 or the second developing device 6 which is selectively used by the depression of one of the selection keys 124, 125. The toner develops the electrostatic latent image to a visible toner image corresponding to the original image. Subsequently, the timing roller 24, which is positioned downstream from the paper feed system P with respect to the direction of transport of the paper, feeds copy paper (not shown) to the surface of the drum 2, as timed with the movement of the toner image by the timing signal, whereupon the toner image is transferred onto the paper. The copy paper bearing the transferred image is separated from the drum surface by the separating charger 8 and then transported by a conveyor belt 25 to the fixing unit 11, in which the toner image is thermally fixed to the paper. The paper is thereafter discharged onto a tray 26.

The toner remaining on the drum surface is removed by the cleaner 9 and collected in the cleaner 9, while the residual charge is removed from the drum surface by the main eraser 10 which is held on during the operation of the main motor.

The paper feed system P includes a manual insertion paper feeder 27, a first cassette paper feeder (hereinafter referred to simply as "first feeder") 28 and a second cassette paper feeder (hereinafter referred to simply as "second feeder") 30. The copy paper inserted through the manual feeder 27 is transported by a manual insertion roller 31 and an intermediate roller 32 to the timing roller 24. The copy paper in each of cassettes 28*a*, 30*a* inserted in the first feeder 28 and the second feeder 30 is sent out by a first feed roller 33 or second feed roller 34 and transported via the intermediate roller 32 to the timing roller 24.

The rollers 24, 31, 32, 33 and 34 are disconnectably connected to a drive system afforded by the main motor via respective clutches (not shown). When the clutch of each roller is engaged, the roller is coupled to the drive system and driven by the main motor. Arranged in the vicinity of the cassettes 28*a*, 30*a* are sensors 35, 36 for detecting the size of copy paper contained in the cassettes 28*a*, 30*a*, and cassette empty sensors 37, 38 for detecting that the copy paper in the cassettes 28*a*, 30*a* has been used up.

With the apparatus shown in FIG. 1 and having the plurality of developing devices, there occurs a difference in density between the visible images developed by the first device 5 and those developed by the second device 6 unless the apparatus is controlled in a particular manner. The difference in the density of visible images directly results in a difference in copy images as transferred and fixed.

When an original is copied, the copies obtained must have the same density regardless of the number of copies. This is also true of the case wherein a copying machine having a plurality of developing devices is operated selectively using any one of the devices. Copies of the same density must always be produced from the same original even if one developing device is changed over to another one. While the density of visible images is dependent on the difference between the developing bias and the surface potential on the photosensitive drum 2 as rotated to the position opposed to the developing device after charging and exposure, the surface potential of the drum decays with time even in the dark. The surface potential starts to decay immediately after the charging. In the case where the time elapsed until the charged drum surface is developed by the first device 5 differs from the corresponding period of time required for the second device 6 to develop the surface as is the case with the apparatus embodying the invention, the amount of decay of the surface potential is different between the developing positions. Equal densities of visible images, i.e., equal developing voltages can be obtained at the different positions, for example, by varying the output of the sensitizing charger, adjusting the developing bias, or adjusting the amount of exposure. A first embodiment of the invention will be described wherein the output of the sensitizing charger 3 is made variable.

Figure 3:
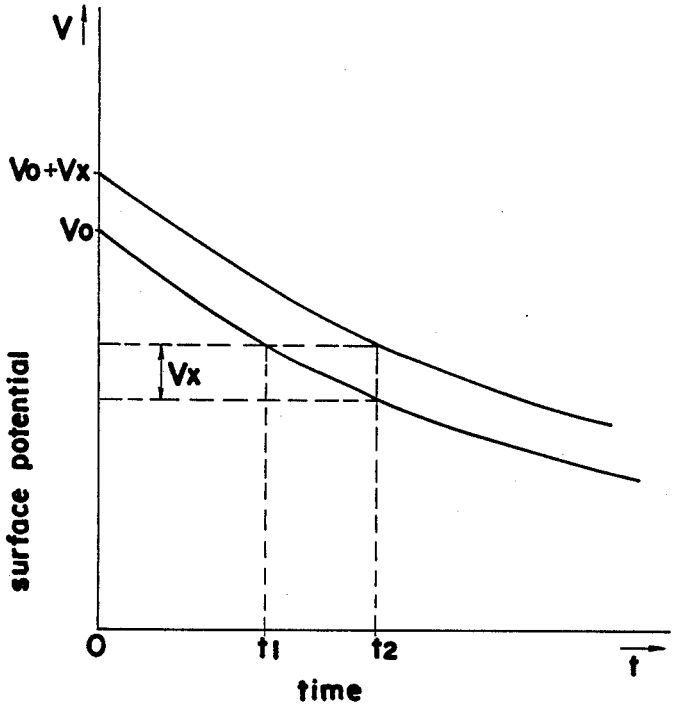
FIG. 3 is a graph showing the dark decay of the surface potential of the photosensitive drum of the machine with the time.
Figure 4:
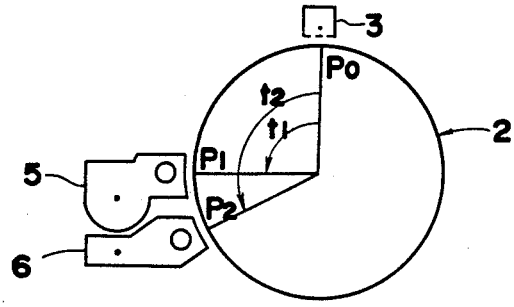
FIG. 4 is a diagram for illustrating the periods of time t1 and t2 in FIG. 3.

FIG. 3 shows the dark decay of the surface potential on the photosensitive drum 2 with time. The diagram reveals that the initial surface potential Vo gradually decays with time and is lower at time t2 than at time t1 by Vx. Thus, the lapse of the time interval t2−t1 lowers the surface potential by Vx. With reference to FIG. 4, t1 is the time required for the drum 2 to rotate from the position P0 opposed to the charger 3 to the position P1 opposed to the first developing device 5, and t2 is the time required for the drum 2 to rotate from the position P0 to the position P2 opposed to the second developing device 6.

Accordingly, equal developing bias levels are available by varying the output of the charger 3 so as to give a surface potential of Vo +Vx for the use of the second developing device 6 relative to the initial surface potential Vo for the use of the first developing device 5.

Figure 5:
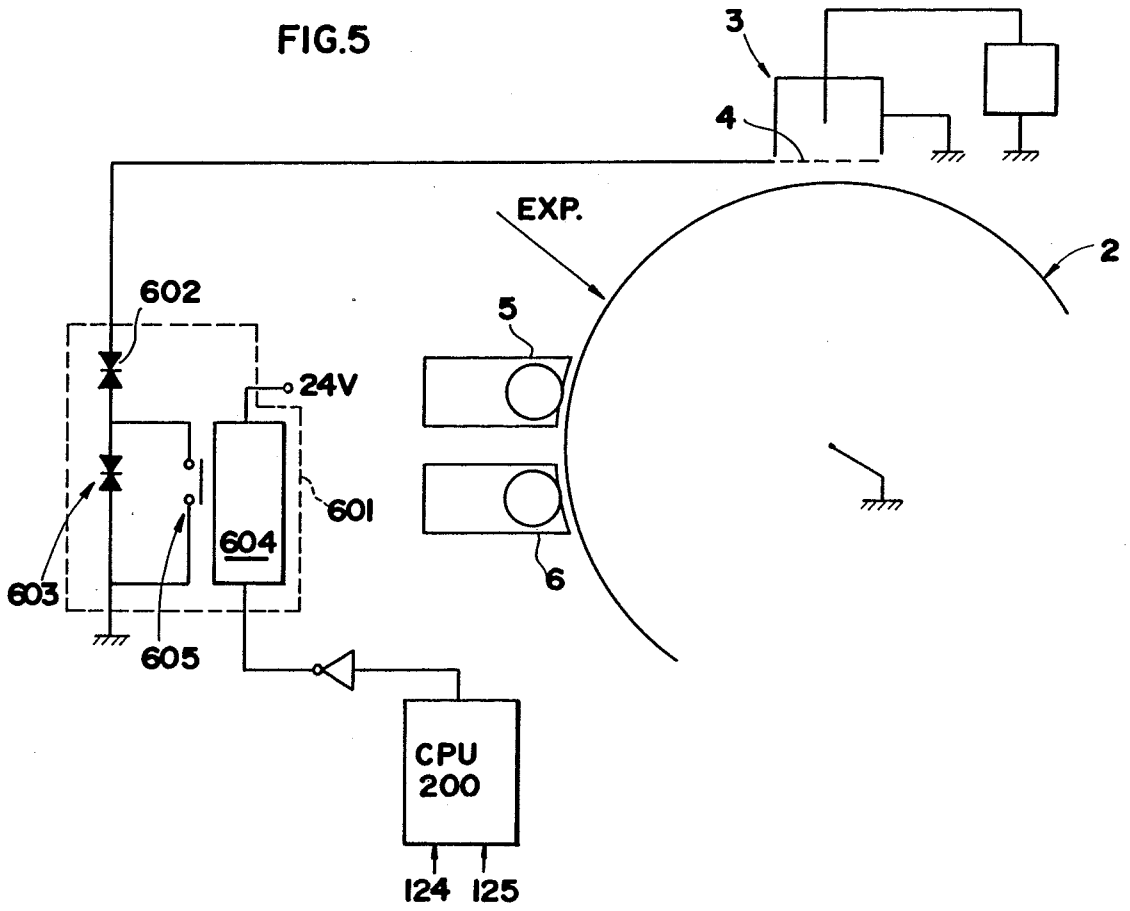
FIG. 5 is a block diagram showing a first embodiment of the invention.

FIG. 5 is a circuit diagram specifically showing the construction of the present embodiment. The charger 3 is a scorotron charger having a wire electrode and a grid electrode 4. The voltage to be applied to the photosensitive drum 2 is maintained at a predetermined value by the grid 4. The voltage of the grid 4 is variable in two levels by a voltage control circuit 601 using the selection keys 124 and 125 on the operation panel already described.

The voltage control circuit 601 includes a relay 604 operable by an output from the CPU 200 and varistors 602, 603. The grid 4 of the charger 3 is grounded via the varistors 602, 603, or alternatively, via the varistor 602 only by the relay 604. When the first developing device 5 is selected by depressing the selection key 124 on the operation panel, the relay 604 is deenergized, thereby closing a switch 605 and causing the varistor 602 to control the output of the charger 3 so as to give the initial surface potential Vo to the drum 2.

The relay 604 is energized when the second developing device 6 is selected by the selection key 125 on the operation panel. This opens the switch 605, causing the varistors 602 and 603 to control the output of the charger 3 to give the initial surface potential Vo +Vx to the surface of the drum 2.

As will be apparent from the above description, the present embodiment exhibits a greater effect when the difference between the time intervals t1 and t2 is greater, for example, when the second device 6 is away from the first device 5, or when the drum 2 rotates at a lower velocity. The embodiment is also very useful when the drum 2 has the characteristics of permitting great dark decay of the surface potential.

Next, a second embodiment of the invention will be described. The basic construction of the copying machine according to this embodiment is the same as that of the first embodiment and therefore will not be described.

This embodiment is so adapted that the developing devices are made different in the developing bias to be applied thereto to afford equal developing voltages.

Figure 6:
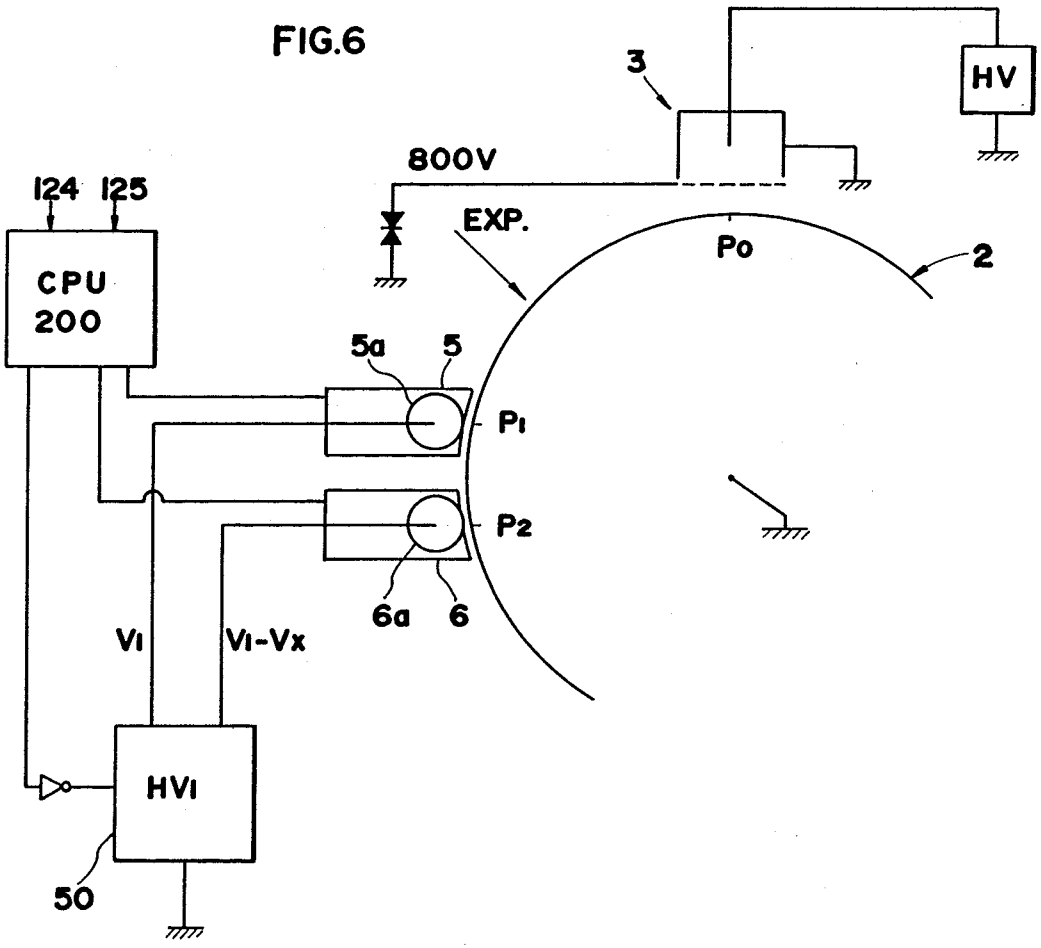
FIG. 6 is a block diagram showing a second embodiment of the invention.

With reference to FIG. 6, developing devices 5 and 6 have developing sleeves 5a and 6a, respectively, each having a magnetic roller in its interior. The developing sleeves 5a, 6a are suitably rotated, whereby the electrostatic latent image on the drum 2 is developed with a developer retained on the peripheral sleeve surface. Each of the developing sleeves 5a, 6a is connected to the main motor through an unillustrated clutch, which is engaged in response to a drive signal from the CPU 200 to transmit the torque of the motor to the sleeve. A voltage of the same polarity as the charger 3, i.e. of positive polarity, is applied to each sleeve 5a (6a) from a power supply HV 50.

As already described with reference to the first embodiment, the initial surface potential Vo on the drum 2 is lower at the position P2 opposed to the second developing device 6 than at the position P1 opposed to the first developing device 5 by Vx.

Accordingly, when it is assumed that the bias voltage to be applied to the sleeve 5a of the first device 5 is V1, the developing voltages to be given by the devices 5, 6 are made equal if the bias voltage to be applied to the sleeve 6a of the second device 6 is set to a value Vx lower than V1, i.e., V1−Vx. Thus, the voltage to be applied to the sleeve 6a of the second device 6 positioned downstream from the first device 5 is made lower than the voltage V1 by the potential Vx which decays while the drum 2 rotates from P1 to P2.

When the selection key 124 is depressed in the present embodiment, the sleeve 5a of the first developing device 5 is driven in response to a drive signal from the CPU 200, and the voltage V1 is applied to the sleeve 5a. Further when the selection key 125 is depressed, the sleeve 6a of the second developing device 6 is driven and is given the voltage V1−Vx.

Next, a third embodiment of the invention will be described. The basic construction of the copying machine according to this embodiment is the same as that of the first embodiment and therefore will not be described.

This embodiment is adapted to change the amount of exposure to thereby eliminate the density difference due to dark decay between the images developed by the first developing device 5 and those developed by the second developing device 6.

Figure 7:
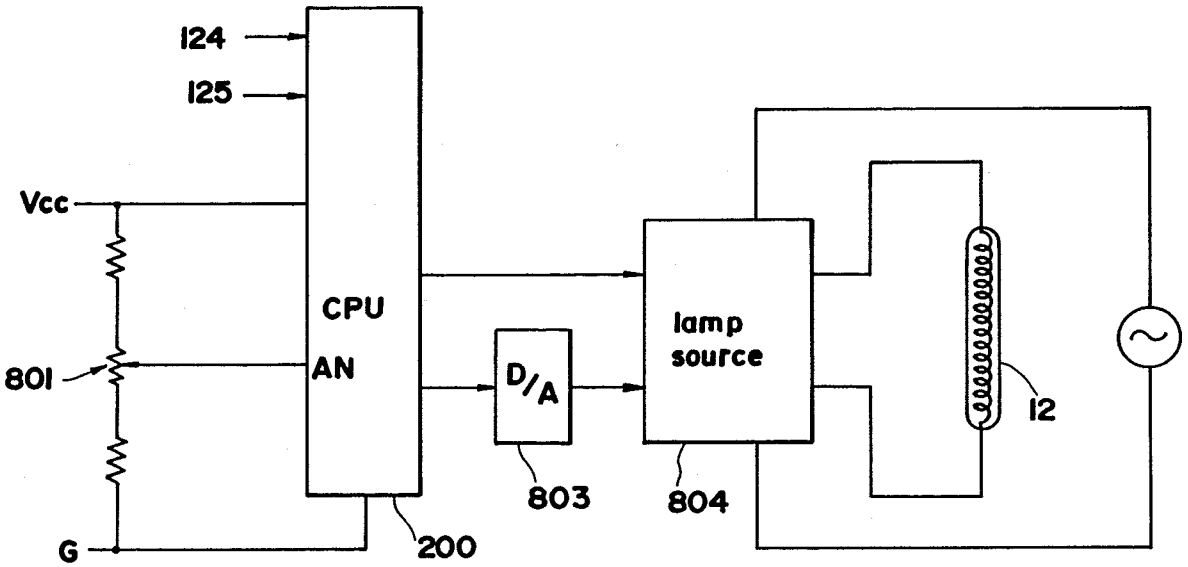
FIG. 7 is a block diagram showing a third embodiment of the invention.

With reference to the circuit diagram of FIG. 7, a voltage determined by the exposure adjusting knob 122 on the operation panel is fed to an analog port of the CPU 200 and subjected to A/D conversion within the CPU 200. The digital lamp voltage data obtained for the developing device which is selected at the same time is fed to a D/A converter 803, from which the analog lamp voltage setting value obtained is fed to a lamp power supply 804. The lamp 12 is turned on by a lighting signal produced from the CPU 200. The lamp voltage (amount of light) is so determined that in the case where the copying machine is operated with the exposure adjusting knob 122 set in the same position for both the first developing device 5 and the second developing device 6, the voltage is lower by an amount corresponding to the amount of dark decay Vx of the surface potential of the photosensitive drum when the first device 5 is selected than when the second device 6 is selected.

Thus, the lamp power supply is so controlled as to give a lamp voltage which is lower for the first device 5 than for the second device 6 by an amount corresponding to the dark decay. With the lamp voltage so adjusted, copy images can be obtained always with a stabilized density regardless of which of the two developing devices 5, 6 is used.

Whereas the distance from the charging position to the developing position differs from device to device to result in variations in the amount of charge on the photosensitive drum, the developing devices included in the copying machine embodying the invention are made equal in developing voltage by controlling the sensitizing charger voltage, developing bias voltage or the amount of exposure of the drum by a control syseem. Consequently, the machine produces copies of the same density from the same original whichever device may be selected for use.

Although the present invention has been described above as embodied as copying machines, the invention is not limited to such embodiments but is applicable also to laser printers adapted to practice an electrophotographic process. For example, the amount of exposure is variable in the same manner as in the third embodiment by controlling the output of the laser.

Although the present invention has been fully described by way of examples with reference to the accompanying drawings, it is to be noted that various changes and modifications will be apparent to those skilled in the art. Therefore, unless otherwise such changes and modifications depart from the scope of the invention, they should be construed as being included therein.

What is claimed is:

1. An image forming apparatus comprising:

a rotatable photosensitive member having a photosensitive layer over its surface;

a charger for charging the photosensitive member;

exposing means for exposing the photosensitive member to form an electrostatic latent image thereon;

a first developing device opposed to the photosensitive member for developing the electrostatic latent image formed on the member;

a second developing device positioned downstream from the first developing device with respect to the direction of rotation of the photosensitive member for developing the electrostatic latent image formed on the member; and for controlling the output of the charger so as to elevate the surface potential of the photosensitive member by a predetermined potential when the second developing device is used, the predetermined potential being equal to a decay potential occurring while the surface of the photosensitive member rotates from the position opposed to the first developing device to the position opposed to the second developing device.

2. An image forming apparatus as claimed in claim 1, wherein said charger includes a wire electrode and a grid electrode for controlling the potential on the photosensitive member and said controlling means controls the voltage applied to the grid electrode of the charger.

3. An image forming apparatus as claimed in claim 1, wherein said exposing means includes a light source and a scanning optical system for scanning an original.

4. An image forming apparatus as claimed in claim 1, further comprising:

first application means for applying a bias voltage to the first developing device; and second application means for applying to the second developing device a bias voltage equal to the output from the first application means.

5. An image forming apparatus comprising:

a rotatable photosensitive member having a photosensitive layer over its surface;

a charger for charging the photosensitive member;

exposing means for exposing the photosensitive member to form an electrostatic latent image thereon;

a first developing device having a rotatable developing roller for developing the electrostatic latent image formed on the photosensitive member;

a second developing device positioned downstream from the first developing device with respect to the direction of rotation of the photosensitive member and having a rotatable developing roller for developing the electrostatic latent image formed on the photosensitive member;

first application means for applying a bias voltage to the developing roller of the first developing device; and second application means for applying to the developing roller of the second developing device a bias voltage lower than the output from the first application means by a predetermined voltage, the predetermined voltage being equal to a decay potential occurring while the surface of the photosensitive member rotates from the position opposed to the first developing device to the position opposed to the second developing device.

6. An image forming apparatus as claimed in claim 5 further comprising:

means for selecting one of the first and second developing devices to be used; and means for rotating either the developing roller of the first developing device or that of the second developing device corresponding to the selection by the selecting means.

7. An image forming apparatus as claimed in claim 5, wherein color of toner stored in the first developing device is different from that of toner stored in the second developing device.

8. An image forming apparatus comprising:

a rotatable photosensitive member having a photosensitive layer over its surface;

a charger for charging the photosensitive member;

means having a light source for locally erasing the charge from the photosensitive member by the light from the light source to thereby form an electrostatic latent image on the member;

a first developing device opposed to the photosensitive member for developing the electrostatic latent image formed on the member;

a second developing device positioned downstream from the first developing device with respect to the direction of rotation of the photosensitive member for developing the electrostatic latent image formed on the member; and control means for increasing the amount of light from the light source of the image forming means by a predetermined amount when the first developing device is used the predetermined amount being an amount required for lowering the surface potential of the photosensitive member by the same amount as potential decay occurring while the surface of the member rotates from the position opposed to the first developing device to the position opposed to the second developing device.

* * * * *